US008444824B2

(12) United States Patent
Juppi et al.

(10) Patent No.: US 8,444,824 B2
(45) **Date of Patent: *May 21, 2013**

(54) PAPER OR BOARD MACHINE EMPLOYING A SINGLE-WIRE DRAW DRYER SECTION

(75) Inventors: Kari Juppi, Palokka (FI); Antti Komulainen, Keuruu (FI)

(73) Assignee: Metso Paper, Inc., Helsinki (FI)

( * ) Notice: Subject to any disclaimer, the term of this patent is extended or adjusted under 35 U.S.C. 154(b) by 0 days.

This patent is subject to a terminal disclaimer.

(21) Appl. No.: 13/021,429

(22) Filed: Feb. 4, 2011

(65) Prior Publication Data

US 2011/0162230 A1 Jul. 7, 2011

Related U.S. Application Data

(63) Continuation of application No. 12/162,570, filed as application No. PCT/FI2007/050038 on Jan. 25, 2007, now abandoned.

(30) Foreign Application Priority Data

Jan. 30, 2006 (FI) ..... 20065061

(51) Int. Cl.
*D21F 9/00* (2006.01)

(52) U.S. Cl.
USPC ..... 162/290; 162/289; 162/292; 162/315; 162/348; 34/116; 34/117

(58) Field of Classification Search
USPC ..... 162/289, 290, 292, 315, 348; 34/116, 34/117
See application file for complete search history.

(56) References Cited

U.S. PATENT DOCUMENTS

| | | | |
|---|---|---|---|
| 4,202,113 | A | 5/1980 | Kankaanpaa |
| 4,876,803 | A | 10/1989 | Wedel |
| 4,888,883 | A | 12/1989 | Kerttula |
| 4,905,380 | A | 3/1990 | Eskelinen et al. |

(Continued)

FOREIGN PATENT DOCUMENTS

| | | | |
|---|---|---|---|
| FI | 83441 | B | 3/1991 |
| WO | 98/48109 | A1 | 10/1998 |

(Continued)

OTHER PUBLICATIONS

Preliminary Report on Patentability issued in PCT/FI2007/050038.

(Continued)

*Primary Examiner* — Jacob Thomas Minskey
(74) *Attorney, Agent, or Firm* — Stiennon & Stiennon

(57) ABSTRACT

A paper or board machine having a machine dryer section with a drying group with single-wire draw. A drying wire (F) presses the web (W) on a drying cylinder (10) against heated cylinder surfaces, and the web (W) remains at the side of the outside curve of reversing cylinders (11) situated between drying cylinders (10). For enhancing runnability of the web (W), a runnability component (20) is in a pocket space (T) confined by two adjacent drying cylinders (10) and a reversing cylinder (11) situated between them and by the drying wire (F). The web (W) passes from the drying cylinder (10) to the reversing cylinder (11) as a short transfer of 80-400 mm, where a negative pressure effect produced by the runnability component (20) is applied and confined by seals of the runnability component (20) against the surfaces of the drying cylinder (10) and reversing cylinder (11).

11 Claims, 4 Drawing Sheets

U.S. PATENT DOCUMENTS

| | | | | |
|---|---|---|---|---|
| 5,044,094 | A | 9/1991 | Ilvespää et al. | |
| 5,063,689 | A * | 11/1991 | Sollinger | 34/115 |
| 5,068,980 | A | 12/1991 | Müller | |
| 5,135,614 | A | 8/1992 | Aula et al. | |
| 5,163,236 | A | 11/1992 | Heikkilä | |
| 5,279,049 | A | 1/1994 | Skaugen et al. | |
| 5,341,579 | A | 8/1994 | Schiel et al. | |
| 5,388,347 | A | 2/1995 | Kerttula et al. | |
| 5,526,579 | A * | 6/1996 | Kade et al. | 34/117 |
| 6,247,247 | B1 * | 6/2001 | Yomaa et al. | 34/425 |
| 6,574,884 | B1 * | 6/2003 | Jokinen | 34/114 |
| 8,011,115 | B2 * | 9/2011 | Komulainen et al. | 34/444 |
| 2007/0172433 | A1 | 7/2007 | Roveri | |
| 2007/0245589 | A1 * | 10/2007 | Laapotti et al. | 34/117 |

FOREIGN PATENT DOCUMENTS

| | | | |
|---|---|---|---|
| WO | 99/23297 | A1 | 5/1999 |
| WO | 0050692 | A1 | 8/2000 |
| WO | 2007/085699 | A1 | 1/2007 |
| WO | 2007/085698 | A1 | 8/2007 |

OTHER PUBLICATIONS

Search Report issued in PCT/FI2007/050038.
Search Report issued in FI 20065061.

* cited by examiner

PAPER OR BOARD MACHINE EMPLOYING A SINGLE-WIRE DRAW DRYER SECTION

CROSS REFERENCES TO RELATED APPLICATIONS

This application is a continuation application of U.S. application Ser. No. 12/162,570 having a 371(c) date of Aug. 12, 2008, the disclosure of which is incorporated by reference herein, said application being a national stage application of International App. No. PCT/FI2007/050038, filed Jan. 25, 2007, and claims priority on Finnish App. No. 20065061, filed Jan. 30, 2006.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to a method in a dryer section of a fiber-web machine, such as a paper or board machine, and to a device in such a machine.

As known from the prior art, drying groups of dryer sections based on cylinder drying in a fiber-web machine, such as a paper or board machine, employ twin-wire draw and/or single-wire draw. In twin-wire draw, the groups of drying cylinders comprise two wires, which press the web, one from above and the other one from below, against heated cylinder surfaces. In single-wire draw, each group of drying cylinders comprises only one drying wire on whose support the web runs through the entire group so that the drying wire presses the web against the heated cylinder surfaces of the drying cylinders and the web remains at the side of the outside curve of the reversing cylinders or rolls situated between the drying cylinders. Thus, in single-wire draw, the drying cylinders are arranged outside the wire loop, and the reversing cylinders or rolls are arranged inside the loop. In the following description, by the term 'reversing cylinder' is also meant a reversing roll alternatively placed in a corresponding position, and the terms 'reversing cylinder' and 'reversing roll' are used synonymously in this description. In the single-wire draw groups of dryer sections based on cylinder drying in fiber-web machines, a pocket space defined by a wire is formed between two adjacent drying cylinders and a reversing cylinder situated between them in a lower row. In connection with the pocket space, we speak of 'opening' and 'closing nips', i.e. 'opening' and 'closing gaps', by which opening nip, or opening gap, is meant an area where the drying wire separates from the drying cylinder and, correspondingly, a closing nip, or a closing gap, is formed on the side of the pocket space when the wire runs to the reversing cylinder. In a similar manner, when the wire leaves the reversing cylinder, an opening nip, i.e. an opening gap, is formed on the outgoing side of the pocket space and, correspondingly, when the wire runs to the next drying cylinder, a closing nip, i.e. a closing gap, is formed between the drying wire and the drying cylinder.

With increasing speeds of fiber-web machines, runnability problems have also begun to occur in the area of single-wire draw, in particular in the first drying cylinder groups of the dryer section. As known from the prior art, attempts have been made to reduce these problems by using different runnability components, such as, for example, blow boxes of the type marketed by Metso Paper, Inc. under the trademark HiRun. One runnability component of this type is described in FI patent 110625, which discloses a blowing device in a fiber-web machine or equivalent, which blowing device comprises a blow box which is arranged at the nip opening from the drying cylinder, i.e. at the opening gap, between the wire and the cylinder and which is provided with at least two nozzles arranged close to the wire. The first nozzle is arranged at the gap opening from the drying cylinder between the wire and the cylinder, for blowing air away from the gap between the wire and the blowing device. The second nozzle is arranged at a distance from said opening gap, in the running direction of the wire. The air jets discharging from the nozzles maintain a negative pressure in the space between the blowing device and the web. In the blowing device, at a short distance from said opening gap, there is further arranged a throttling member projecting toward the wire and dividing the negative pressure space formed between the first nozzle and the second nozzle into a first region of an intensified negative pressure confined to the location of the opening gap and into a second region of a lower negative pressure. An arrangement is also known from the state of the art in which there are mechanical seals on both sides of the opening gap and, in addition, there are suctions.

Seals placed in connection with blowing devices and equivalent are used in connection with runnability components for the purpose of confining desired negative pressure areas. If the tension of the drying wire is not correct, the wire may bend in the direction of the negative pressure of the runnability component and wear the seals of said component on the side of the wire, after which the runnability component no longer operates in the desired manner. This leads to loss of runnability and, at the same time, to a reduction of efficiency as the rate of production decreases, and the economical losses resulting from this can be really great.

Different arrangements are known from the state of the art in which attempts have been made to maintain the tension of the drying wire and, in particular, to prevent the wire from bending in the area of the gap opening from the drying cylinder and to prevent wear of the seals of the runnability component. The most common known arrangement to prevent the bending of the wire has been to increase the tension of the wire, for example, based on information provided by different wire-tension monitoring arrangements. One arrangement of this kind is described in FI patent application 20040048. On the other hand, attempts have been made to control the wire-bending problem, arising from the negative pressure caused by runnability components, in the area of the gap opening from the drying cylinder by lowering the level of the negative pressure. This, however, leads to runnability problems. The final solution for wear of the seals of negative-pressure components caused by the bending of the wire has naturally been to replace the seals with new ones until these wear again.

On the other hand, with respect to the state of the art, reference can be made to FI patent application 912416 and to FI laid-open publication 83345. These prior-art problem-solutions comprise arrangements in connection with a dryer section of a paper machine in which, in drying groups based on cylinder drying in the dryer section, the run between a drying cylinder and a reversing cylinder or roll in the area of an opening gap has been arranged to be short. By this kind of arrangement it is possible to improve to some extent the problems associated with the bending caused by too low wire tension but, on the other hand, it is problematic, among other things, because of shortage of space, to place runnability components known from the state of the art in connection with this kind of gap opening from a drying cylinder where the run to the next reversing cylinder is short.

With respect to the state of the art, reference can also be made to FI patent 77288, which describes an arrangement in which, in connection with a transition from a drying cylinder group applying single-wire draw to a drying cylinder group applying twin-wire draw, a special group-gap cylinder is used in the gap between the groups, and a suction tube device is arranged in connection with the group-gap cylinder, and in which the transfer from the last drying cylinder of the drying group applying single-wire draw to this special group-gap cylinder is arranged to be short.

SUMMARY OF THE INVENTION

An object of the invention is to provide a method and a device in a dryer section of a fiber-web machine, such as a paper or board machine, in which attempts have been made to eliminate and/or minimize the above-noted problems associated with the state of the art, in particular with the bending of the drying wire when it is passed from a drying cylinder to a reversing cylinder in a drying group applying single-wire draw and when a runnability component is used in this connection to improve runnability.

In accordance with the invention, a runnability component is arranged at the transfer from a drying cylinder to a reversing cylinder in a drying group applying single-wire draw in a dryer section of a fiber-web machine, such as a paper or board machine, which runnability component is arranged to be sealed against the fabric-covered surface of the drying cylinder and against the fabric-free surface of the reversing roll, and, at the same time, the length of the wire run between the drying cylinder and the reversing roll is minimized. By this means, the bending of the wire is reduced and, at the same time, wear of the seals of the runnability component is reduced and, in addition, runnability is improved on said run. Also, as compared to the runnability components of high negative pressure available on the market, for example, runnability components of the type marketed under the trademarks HiRun and Prorelease having at least two seals on the run of a flexible fabric, an additional advantage obtained from an arrangement of a single seal on the run of the fabric from a cylinder to a reversing roll is the fact that the possible bending of the runnability component can be arranged to be parallel with the cylinder/wire surface by the selection of the axis of inertia, so that the seal does not wear the wire or vice versa, but the bending is received by a flexible/self-adjusting sealing arrangement on the reversing cylinder, and so that the bending does not change the runnability situation nor the negative pressure. In this way, the invention makes it possible to avoid bending problems as compared with the state-of-the-art runnability components because a great suction effect is surprisingly applied to a gap situated between the wire and the reversing cylinder and closing on the reversing cylinder and, at the same time, to an opening gap between the cylinder and the wire with the same negative pressure effect, and not directly against the wire and the drying cylinder only at the opening gap of the cylinder and the wire.

The runnability component in accordance with the invention is advantageously provided with a seal based on mechanical sealing. It is also possible to use a sealing arrangement based on blows or on a combination of mechanical sealing and blowing sealing. In the arrangement in accordance with the invention, the distance of the seals of the runnability component to the drying cylinder surface remains constant, whereby possible air leakages and wear of the seals wearing with the flexible fabric are eliminated because the seal to be situated against the wire can be placed outside the bending range in question as compared with an arrangement having all seals on a long flexible fabric run. In addition, the arrangement in accordance with the invention allows a smaller pocket space, i.e. a smaller space between adjacent drying cylinders and a reversing cylinder between them, so that the air amounts used in the runnability component for producing a required negative pressure are smaller, as compared with the prior art arrangements, typically the air amount required is of the order of 200-600 $m^3$/hm.

Different suction duct arrangements according to the required negative pressure can be accomplished on the negative pressure zone in accordance with the invention, said zone being directed at the gap closing on the reversing cylinder and confined by the drying cylinder, the reversing cylinder and the drying wire. A negative pressure effect/suction can be produced only from the reversing cylinder, only from the runnability component, or from both of them, of which the last-mentioned alternative is particularly suitable for situations in which a high negative pressure is needed, i.e., for example, in wide and fast machines. Moreover, the required negative pressure varies between different paper grades and in different drying stages, typically, at the beginning of the dryer section, a higher negative pressure is needed than at its end. Further, the quality of paper can be improved by arranging a smaller draw difference for the draw from the press section to the dryer section, in which case the negative pressures in the runnability components at the beginning of the dryer section must be still higher to maintain runnability.

In accordance with one advantageous additional feature of the invention, a sealing arrangement is provided on the side of the transfer taking place from the reversing cylinder to the following drying cylinder, i.e. on the side of the gap opening from the reversing cylinder, which sealing is preferably a blow seal arrangement because on this side a negative pressure area is inherently effective because of the opening gap of the reversing cylinder and the wire.

In accordance with one advantageous additional feature of the invention, the reversing cylinder is arranged to be movable such that the distance of the reversing cylinder with respect to the drying cylinder can be adjusted and in such a way that the reversing cylinder can be arranged to avoid a damaged paper/wire portion of possibly several layers not able to pass through a minimum gap between the drying cylinder and the reversing cylinder, which gap is determined by the combined thickness of the wire and the web, being about 1 mm. This advantageous additional feature also makes it possible to move the reversing cylinder, for example, to a wire replacement position, for example, at a distance of 30 mm.

The arrangement in accordance with the invention is suitable for use in connection with drying groups applying single-wire draw in a dryer section of many different types of fiber-web machines. The structural alternatives of drying cylinders, reversing cylinders and the wire can be manifold, in themselves known by a person skilled in the art. The reversing cylinder used in connection with the invention can be a perforated reversing cylinder, a grooved reversing cylinder or a reversing cylinder provided with both perforations and grooves, known per se. With a view to producing a negative pressure effect in the reversing cylinder, the reversing cylinder can be equipped with a suction box producing a negative pressure or it can be without it, i.e., for example, a reversing cylinder without an internal suction box of the type marketed by Metso Paper, Inc. under the trademark Vac-Roll, whose suction effect extends over the entire circumference.

In the following, the invention will be described in more detail with reference to the figures in the appended drawing, but the invention is not meant, by any means, to be narrowly limited to the details of them.

DESCRIPTION OF THE PREFERRED EMBODIMENTS

Figure 1:
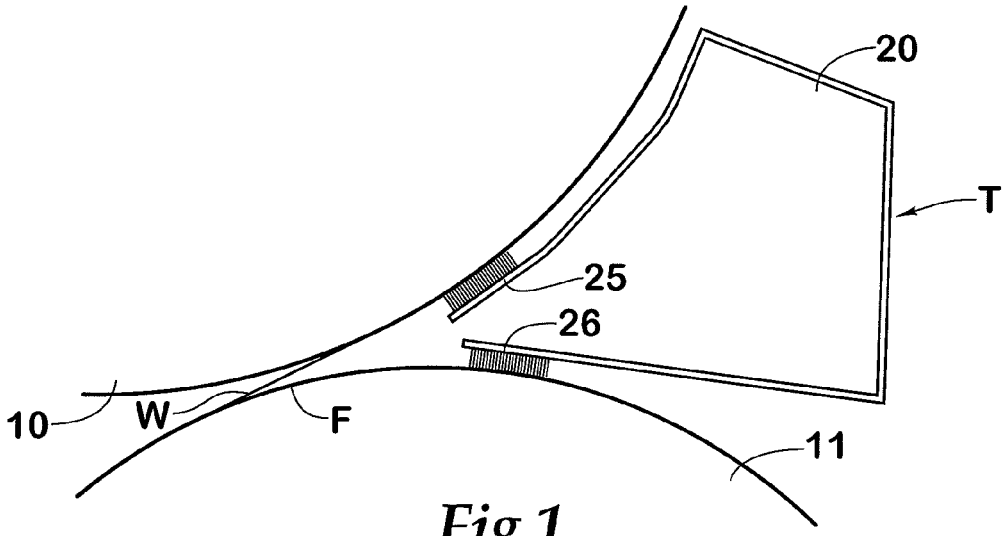
FIG. 1 schematically shows one embodiment of the invention.

FIG. 1 shows one embodiment of the arrangement in accordance with the invention, placed in a group of drying cylinders applying single-wire draw in a dryer section of a fiber-web machine, such as a paper or board machine, which figure shows, of the drying group, a drying cylinder 10 and a reversing cylinder 11 placed below it. A paper web W that is being dried runs on support of a drying wire F from the drying cylinder 10 to the reversing cylinder 11 and further in a similar manner of normal single-wire draw. A runnability component 20 in accordance with the invention is placed in a pocket space T remaining between the drying cylinder 10, o the reversing cylinder 11 and the next drying cylinder (not shown) and the drying wire F, which runnability component produces a negative pressure that is used for enhancing the runnability of the paper web W in cylinder drying, in particular in an area of a gap opening from the drying cylinder 10. The runnability component 20 produces a negative pressure area on the run of the web W and the wire F from the drying cylinder 10 to the reversing cylinder 11, which negative pressure area is confined by seals 25, 26 sealing the operating area of the runnability component 20 to the run of the wire F in the area between the surface of the drying cylinder 10 and the surface of the reversing cylinder 11. In the embodiment shown in the figure, the runnability component 20 is provided with mechanical seals 25, 26 but, when needed, for example, in connection with low negative pressures or, for example, on a grooved surface of the reversing cylinder 11 it is possible to use a sealing arrangement accomplished by means of blows, in itself known from the state of the art.

In the arrangement of the invention, the distance from the drying cylinder 10 to the reversing cylinder 11 is minimized and this length of a common tangent between the points of contact is 80-400 mm, most preferably 100-250 mm. By this is meant the theoretical path of the wire without a negative pressure in the runnability component and when the machine is at a standstill.

The negative pressure produced by the runnability component 20 in accordance with the invention is 300-10,000 Pa, advantageously at least 1000 Pa.

Figure 2:
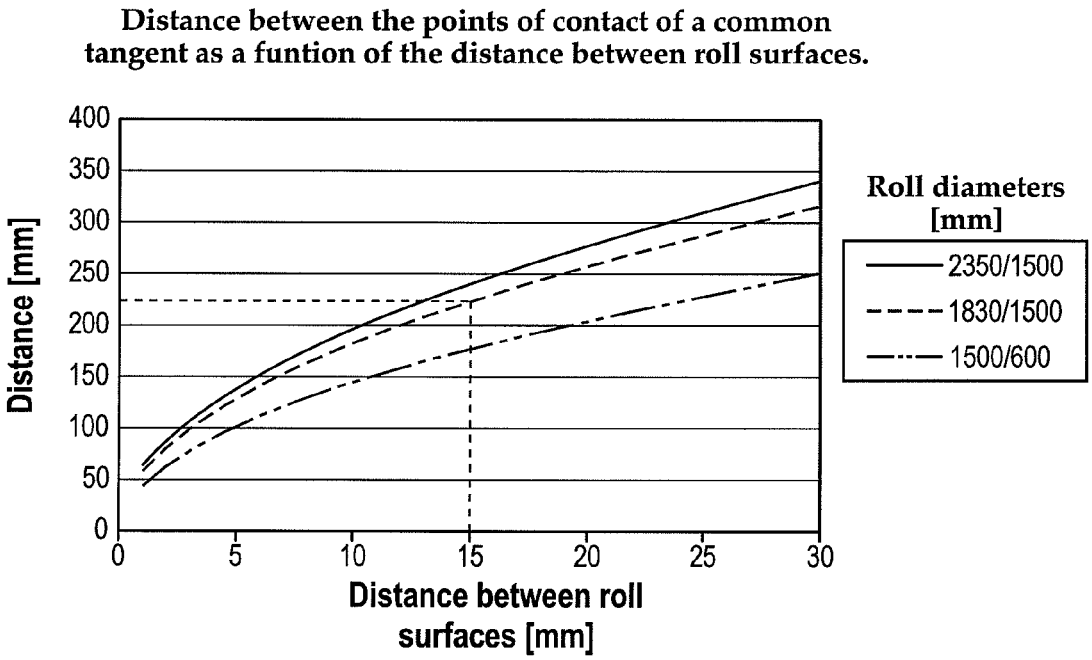
FIG. 2 schematically shows the distance between the points of contact of a common tangent as a function of the distance between roll surfaces.

FIG. 2 schematically shows the distance between the points of contact of a tangent common to the drying cylinder and the reversing cylinder as a function of the distance between the roll surfaces of the drying cylinder and the reversing cylinder. In the figure, the X-axis, i.e. the horizontal axis, represents the distance between the roll surfaces on a line passing through the centers of the rolls, and the Y-axis, i.e. the vertical axis, represents the distance between the points of contact of the common tangent. In this schematic representation, the thickness of the wire has not been taken into account. The roll diameters corresponding to the curves shown in the figure are distinguished from one another by means of lines of different thicknesses. As is clear from the figure, for example, in a situation where the distance between the roll surfaces is 15 mm, the distance from the opening gap to the closing gap, i.e. the distance between the points of contact of the common tangent, is 224 mm while the diameters of the drying cylinder and the reversing cylinder are 1830 and 1500 mm.

Figure 3:
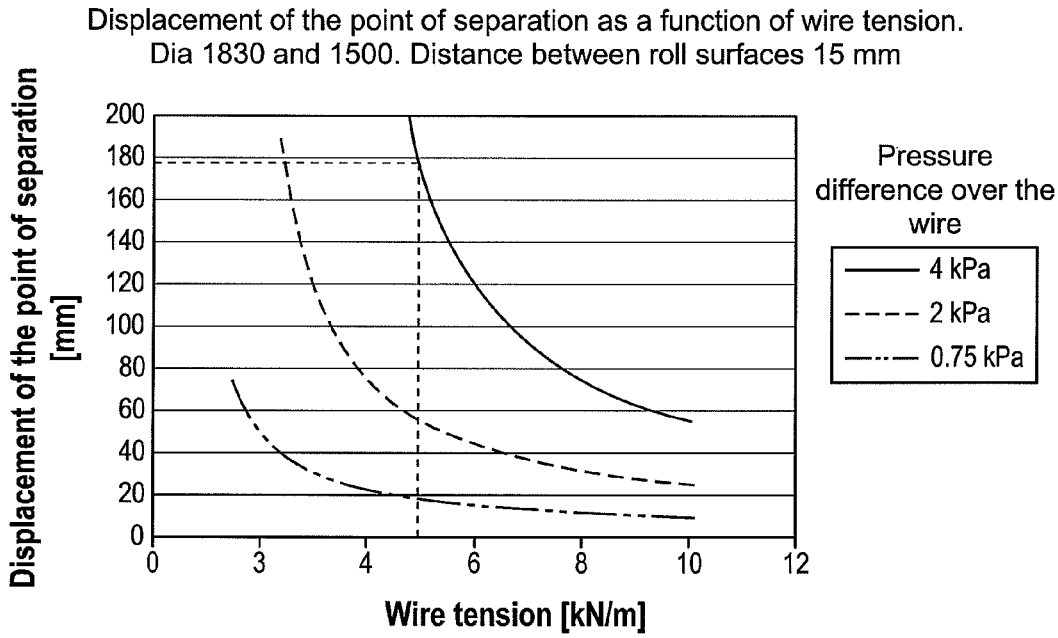
FIG. 3 schematically shows the displacement of the point of separation of the wire as a function of wire tension.

FIG. 3 schematically shows the displacement of the point of separation as a function of wire tension. In the figure, the gap opening from the drying cylinder moves 178 mm along the surface of the cylinder when the tension of the wire is 5 kN/m and the negative pressure over the wire is 4 kPa while the diameters of the drying cylinder and the reversing cylinder are 1830 mm and 1500 mm and the distance between the roll surfaces is 15 mm. In reality, the displacement is smaller because the negative pressure in the opening gap of the drying cylinder acts in a direction opposite to the suction present on the other side of the wire, and thus has a reducing effect on the displacement. In the figure, it can be read from the same curve that the drop of tension to, for example, 4 kN/m has an adverse effect on the displacement when the separation point moves out of a scale considered reasonable, and may thus even have a wearing effect on a seal situated farther away. On the other hand, decreasing the negative pressure to one-half reduces the displacement of the separation point to one-third, which also means a better drying capacity as the wire now presses the web over a longer distance against the drying cylinder.

Figure 4:
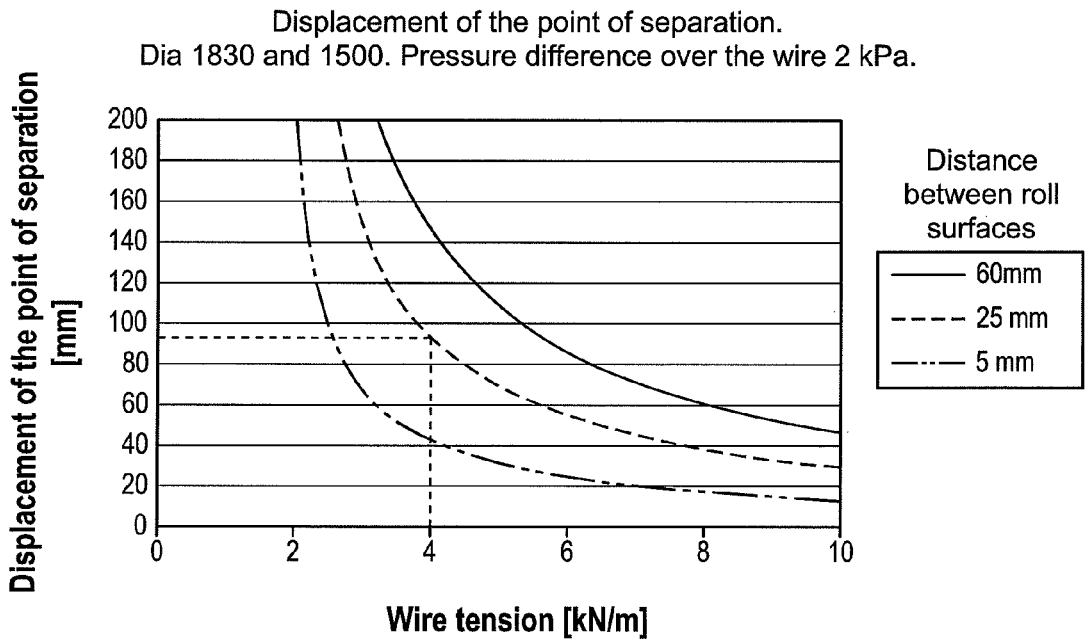
FIG. 4 schematically shows the displacement of the point of separation.

FIG. 4 in turn shows the displacement of the point of separation when the pressure difference over the wire is over 2 kPa, i.e. when the negative pressure in the pocket space is 2 kPa, the tension of the wire is 4 kN/m and the distance between the roll surfaces is 25 mm, the displacement of the separation point of the gap opening from the cylinder is 94 mm.

Figure 5:
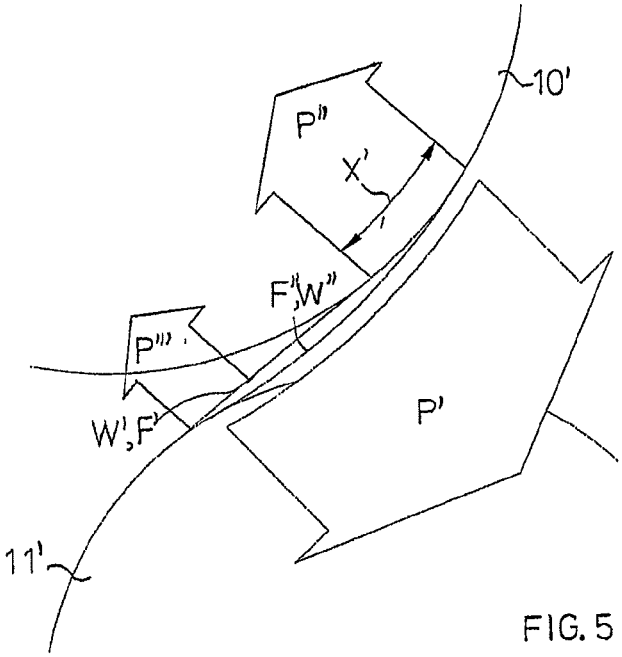
FIG. 5 schematically shows how a pressure difference over the wire changes the location of the opening gap formed by the wire and the cylinder.

In accordance with FIG. 5, as is clear from the curve chart described above, a negative pressure P' produced by means of the runnability component over a wire F' and a web W changes the location of a gap opening from a drying cylinder 10' by a distance X'. In the figure, the effect of the negative pressure in the opening gap and the effect of the adhesion of the cylinder are indicated by the arrow P", and the effect of the air carried with the wire and the reversing cylinder on the web/wire W, F1 is indicated by the arrow P'. By means of the runnability component and by means of the arrangement in accordance with the invention it is achieved that P' is greater than P"+P'". In addition, the figure shows, by way of example, the effect of the negative pressure P' of the runnability component on the run of the web/wire W"/F" when bent towards the runnability component.

Figure 6:
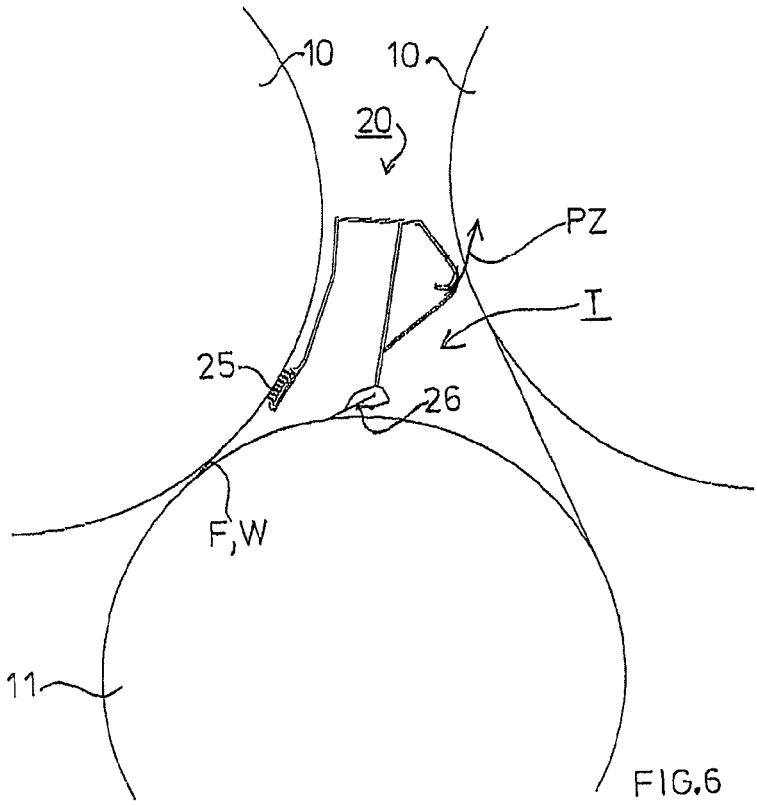
FIG. 6 schematically shows one embodiment of the invention.

FIG. 6 shows one embodiment of the invention in which the sealing of a runnability component 20 takes place, in accordance with the invention according to the embodiments described above, against the surfaces of the drying cylinder 10 and the reversing cylinder 11 by means of seals 25, 26 and by means of a blow seal arrangement PZ arranged, in connection with the runnability component 20, on the side of the gap closing on the next drying cylinder of a pocket space T. The seal 26 placed against the reversing cylinder 11 shown in the figure is a so-called doctor seal.

Figure 7:
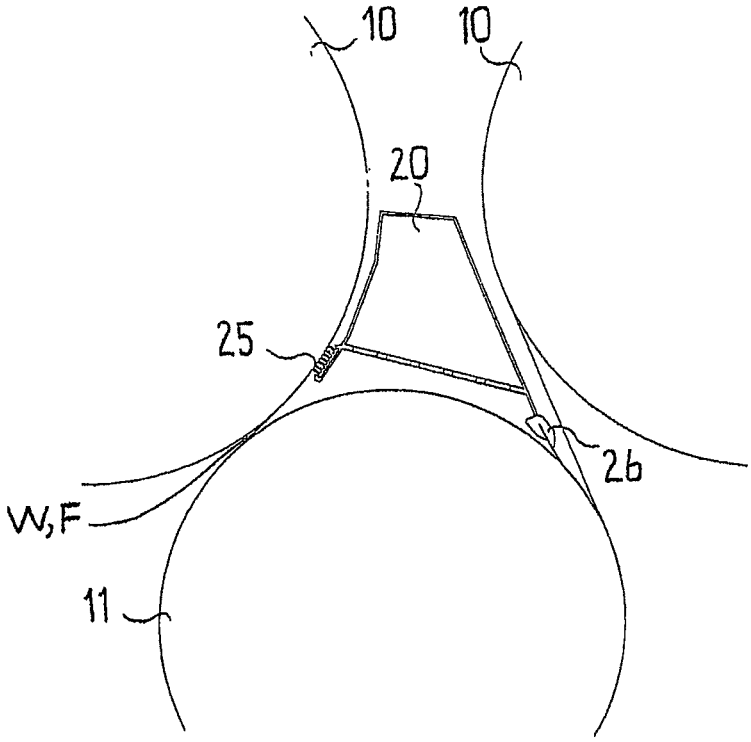
FIG. 7 schematically shows one embodiment of the invention.

FIG. 7 shows one embodiment of the invention in which the sealing of a runnability component 20 takes place, in accordance with the invention according to the embodiments described above, against the surfaces of the drying cylinder 10 and the reversing cylinder 11 by means of seals 25, 26. In this embodiment of the invention, a mechanical seal 25 is arranged against the surface of the drying cylinder 10 in accordance with the invention and the other seal, i.e. the seal placed against the surface of the reversing cylinder 11 is a so-called doctor seal, which is arranged very close to the gap opening from the reversing cylinder. In addition, in the arrangement there is no sealing on the cylinder on the outgoing side.

In the arrangement in accordance with the invention, in which the running distance of the wire from the drying cylinder 10 to the reversing cylinder 11 has been minimized, the short running distance reduces the bending of the wire F, thus reducing the problems of the arrangements known from the state of the art. Hence, the point of separation of the wire F from the drying cylinder 10 also does not change so much because the distance is shorter and the bending of the wire F is smaller. When the arrangement of the invention is used, the problems arising from a long running distance and from a change in the point of separation can be solved, which means that the operation of the runnability component is more reliable and, thus, the runnability of the drying group improves.

Above, the invention has been described only with reference to some of its advantageous exemplifying embodiments, but the invention is not by any means meant to be narrowly limited to the details of them.

We claim:

1. A method of enhancing runnability in a paper or board machine, comprising the steps of:

drying a paper web in a dryer section of the paper or board machine in at least one drying group which employs single-wire draw in which a paper web is dried on a first heated cylinder surface of a first drying cylinder supported by a drying wire that presses the web onto the first heated cylinder surface;

traversing the web from the first drying cylinder on an outside surface of the drying wire to a cylindrical surface of a reversing roll along a transfer length of 80-400 mm along a common tangent, so the drying wire engages said cylindrical surface overlain by the paper web, and further transferring the web from the reversing roll to a second heated cylinder surface of a second drying cylinder supported by the drying wire which presses the web onto the second heated cylinder surface;

wherein the first drying cylinder, the second drying cylinder and the reversing roll positioned between the first drying cylinder and the second drying cylinder, form together with the drying wire a pocket space therebetween;

enhancing the runnability of the web by using a runnability component placed in the pocket space, to produce a selected negative pressure of at least 1000 Pa in an area which is applied substantially uniformly along the entire transfer length to the web as the web transfers between the first drying cylinder to the reversing cylinder and confining the area of the negative pressure between the first drying cylinder and the reversing roll with a first mechanical seal mounted to the runnability component and positioned against the first heated cylinder surface of the first drying cylinder and a second mechanical seal mounted to the runnability component and positioned against a portion of the cylindrical surface of the reversing cylinder not wrapped by the drying wire;

wherein the step of traversing the web from the first drying cylinder on an outside surface of the drying wire to a cylindrical surface of a reversing roll begins at an opening gap, opening away from the first drying cylinder where the web leaves the first drying cylinder, and wherein the mechanical seal positioned against the first heated cylinder surface of the first drying cylinder is spaced from the opening gap along the first heated drying cylinder surface such that at the selected negative pressure the opening gap does not open to such an extent that the drying wire is pressed against the mechanical seal positioned against the first heated cylinder surface of the first drying cylinder.

2. The method of claim 1 further comprising the step of producing a negative pressure effect on the drying wire during the further transferring from the reversing cylinder to the second drying cylinder, by using a blow seal mounted to the runnability component, and directed against the surface of the second heated cylinder surface.

3. The method of claim 1 wherein the step of traversing the web from the first drying cylinder on the outside surface of the drying wire to the cylindrical surface of the reversing roll is along a transfer length of 100-250 mm along a common tangent.

4. The method of claim 1 wherein the step of enhancing the runnability of the web by using the runnability component placed in the pocket space comprises producing a negative pressure of at least 2000 Pa in the area which is applied to the web as the web transfers between the first heated drying cylinder to the reversing cylinder.

5. The method of claim 1 wherein the step of enhancing the runnability of the web by using the runnability component placed in the pocket space, comprises producing a negative pressure of at least 4000 Pa in the area which is applied to the web as the web transfers between the first heated drying cylinder to the reversing cylinder.

6. A paper or board machine comprising:

a dryer section having at least one single-wire draw type drying group wherein a paper web is arranged to traverse a first heated cylinder surface of a first drying cylinder supported by a drying wire having a surface that presses the web onto the first heated cylinder surface, the paper web on the drying wire extending from the first drying cylinder on the surface of the drying wire to a cylindrical surface of a reversing roll along a transfer of a length of between 80-400 mm along a common tangent, such that the drying wire engages said reversing roll cylindrical surface and is overlain by the paper web;

wherein the paper web extends in a further transfer from the reversing roll to a second heated cylinder surface of a second drying cylinder, the web being supported by the drying wire and the drying wire arranged to overlie and to press the web onto the second heated cylinder surface;

wherein the first drying cylinder, the second drying cylinder and the reversing roll positioned between the first drying cylinder and the second drying cylinder form together with the drying wire a pocket space therebetween;

a runnability component positioned in the pocket space, the runnability component positioned between the first heated drying cylinder, the reversing cylinder and the second heated drying cylinder, and the runnability component defining a negative pressure area between a first mechanical seal mounted to the runnability component and positioned against the first heated cylinder surface and a second mechanical seal mounted to the runnability component and positioned against a portion of a surface of the reversing cylinder not wrapped by the drying wire, so that the negative pressure area overlies the transfer substantially uniformly along the entire transfer length;

wherein the negative pressure area is connected to a source of negative pressure of at least 1000 Pa.

7. The paper or board machine of claim 6 further comprising a blow seal connected to the runnability component and so placed as to be directed against the second heated cylinder surface after the further transfer from the reversing cylinder to the second drying cylinder.

8. The paper or board machine of claim 6 wherein the length of the transfer from the first drying cylinder to the reversing roll is 100-250 mm along a common tangent.

9. The paper or board machine of claim 6 wherein the negative pressure area is connected to a source of negative pressure of at least 2,000 Pa.

10. The paper or board machine of claim 6 wherein the negative pressure area is connected to a source of negative pressure of at least 4,000 Pa.

11. A paper or board machine, comprising:

a dryer section having at least one single-wire draw type drying group wherein a paper web is arranged to traverse a first heated cylinder surface of a first drying cylinder supported by a drying wire having a surface that presses the web onto the first heated cylinder surface, the paper web on the drying wire extending from the first drying cylinder on the surface of the drying wire to a cylindrical surface of a reversing roll along a transfer of a length of between 80-250 mm along a common tangent, such that the drying wire engages said reversing roll cylindrical surface and is overlain by the paper web;

wherein the paper web extends in a further transfer from the reversing roll to a second heated cylinder surface of a second drying cylinder, the web supported by the drying wire and the drying wire arranged to overlie and to press the web onto the second heated cylinder surface;

wherein the first drying cylinder, the second drying cylinder and the reversing roll positioned between the first drying cylinder and the second drying cylinder, form together with the drying wire a pocket space therebetween;

a runnability component positioned in the pocket space, the runnability component being positioned between the first drying cylinder, the reversing cylinder and the second drying cylinder, and the runnability component defining a negative pressure area arranged to apply negative pressure substantially uniformly between a first mechanical seal mounted to the runnability component and positioned against the first heated cylinder surface of the first drying cylinder and a second mechanical seal is a doctor seal mounted to the runnability component and positioned to engage with a portion of the surface of the reversing cylinder not wrapped by the drying wire, so that the negative pressure area overlies the transfer;

wherein the drying wire has a tension of at least 4 kN/m; and wherein the negative pressure area is connected to a source of negative pressure of at least 1,000 Pa to 10,000 Pa.

* * * * *